United States Patent [19]

Brady et al.

[11] 4,405,264

[45] Sep. 20, 1983

[54] METHOD OF PROVIDING EARTH COVERING USEFUL FOR WATER HARVESTING

[75] Inventors: Sam A. Brady; Michael G. Elias, both of Midland, Mich.

[73] Assignee: Dow Corning Corporation, Midland, Mich.

[21] Appl. No.: 288,253

[22] Filed: Jul. 30, 1981

[51] Int. Cl.[3] ..... E02B 5/02

[52] U.S. Cl. ..... 405/270; 405/258; 405/52; 428/266

[58] Field of Search ..... 405/270, 118, 258, 128, 405/129; 428/266, 268, 447; 528/18-23

[56] References Cited

U.S. PATENT DOCUMENTS

| | | | |
|---|---|---|---|
| 2,170,671 | 8/1939 | Adler | 405/118 |
| 3,189,576 | 6/1965 | Sweet | 528/22 X |
| 3,294,725 | 12/1966 | Findlay et al. | 528/23 X |
| 3,334,067 | 8/1967 | Weyenberg | 528/17 |
| 3,474,625 | 10/1969 | Draper et al. | 405/270 |
| 3,485,661 | 12/1969 | Campbell et al. | 428/266 |
| 3,555,828 | 1/1971 | Goldstein et al. | 405/264 |
| 3,763,072 | 10/1973 | Krieger | 405/270 X |
| 3,949,113 | 4/1976 | Draper et al. | 405/270 X |
| 4,207,017 | 6/1980 | Jarrel | 405/270 |
| 4,221,688 | 9/1980 | Johnson et al. | 528/18 X |
| 4,230,061 | 10/1980 | Roberts et al. | 428/266 X |
| 4,293,440 | 10/1981 | Elphingstone et al. | 405/270 X |

OTHER PUBLICATIONS

*Proceedings of the Water Harvesting Symposium,* Phoenix Arizona, Mar. 26-28, 1974, Agriculture Research Service.

USDA, GPO 791-043; Michelson, pp. 93-102; McBride & Shiflet, pp. 115-121; Dedrick, pp. 175-191. Plueddemann, pp. 76-83.

*Primary Examiner*—Dennis L. Taylor

*Attorney, Agent, or Firm*—Roger H. Borrousch

[57] ABSTRACT

A method of constructing a means suitable for directing, transporting or holding water is disclosed. Cloth is layed upon a surface convenient to a depression suitable to direct, transport, or hold water. The cloth is coated with a liquid silicone elastomeric composition curable at atmospheric conditions. The composition cures to an elastomer having a modulus which provides sufficient flexibility to the coated cloth so that the coated cloth will assume the contour of the depression, the coated cloth being impervious to liquid water. After curing, the coated cloth is moved to the depression and placed into the depression to cover the surface of the depression. The coated cloth is bonded at seams and the perimeter of the coated cloth is stabilized. The method yields a structure that is economical to manufacture, yet has a long, useful life in such applications as catchments, irrigation ditches, and holding ponds.

33 Claims, 13 Drawing Figures

METHOD OF PROVIDING EARTH COVERING USEFUL FOR WATER HARVESTING

BACKGROUND OF THE INVENTION

1. Field of the Invention

This invention relates to a method of providing an earth covering useful for water harvesting. The method provides a cloth reinforced elastomeric silicone membrane, impervious to water, that lines a depression suitable to direct, transport, or hold water and prevents the loss of water into the earth.

2. Description of the Prior Art

Water harvesting is a technique for developing local water supplies for such things as livestock, wildlife, runoff farming, and domestic use. Ancient desert farmers cleared hillsides and smoothed the soil to increase the amount of rain water that flowed down the hill. Contour ditches carried the runoff to lower lying fields where the water was used to irrigate crops.

In more recent history, the collection of rainwater from the roofs of homes and its storage in a cistern was common practice until the widespread development of central water systems in cities.

Systems have been evaluated for collecting water supplies for livestock in semiarid rangeland. Mikelson has reported on the use of metal sheeting, butyl rubber sheeting, asphalt roofing, and soil-bentonite mixtures as methods of collecting water for transportation to storage areas. Mikelson's report in "Proceedings of the Water Harvesting Symposium, Phoenix, Arizona, Mar. 26–28, 1974," published by the Agricultural Research Service, U.S. Department of Agriculture, indexed as GPO791-043, pages 93 to 102, concludes that water harvesting catchments tested can be useful, but the costs are high. The effects of weathering reduces the useful life of all methods. High winds and sunlight tend to destroy the covering materials. McBride and Shiflet report in the same reference, pages 115 to 121, on water harvesting catchments of various types, including glass fiber-asphalt constructions. Those glass fiber-asphalt constructions coated the soil, after sterilization, with glass fiber mat which was then coated with cationic liquid asphalt emulsion and overcoated with roofing type clay asphalt emulsion. The emulsion requires replacement at 3 to 5 year intervals. The surface was often broken by plants, burrowing rodents and ants. Dedrick reports in the same reference on storage systems at pages 175 to 191. In addition to methods mentioned above, he discusses the use of plastic film, ethylene-propylene rubber and chlorosulfonated polyethylene sheeting, and hard surface linings such as portland cement concrete. The rubber coatings must be protected from mechanical damage and weathering. The hard surface linings are expensive to install and subject to damage from alternating freezing and thawing.

In the same reference, at pages 76 to 83, Plueddemann reports on testing under laboratory conditions a variety of latex polymers and water repellants for suitability for treatment of soil to improve water harvesting. His recommendation is a mixture of an SBR latex mixed with an emulsion of silicone fluid. Experiments are given to show usefulness, but all work was in a laboratory as experiments. In his conclusion he states that the silicone emulsion alone is completely ineffective, but is a very effective water repellent when mixed with a suitable polymer latex.

A companion technique for the development of local water supplies is the use of canals or ducts to transport water from an available source to the desired predetermined location. The source, of course, must be located high enough above the predetermined location so that the water will flow with sufficient velocity to deliver the required amounts. Canals, aquaducts, and irrigation ditches have varied in construction from earthen ditches to concrete lined ditches and masonry aquaducts. Lining ditches with concrete is difficult and expensive, so it has been primarily confined to large canals. In small ditches or ducts as used in irrigation systems, the cost of concrete linings is prohibitive.

An earthen ditch such as used in irrigation systems can waste a majority of the water that enters the system. Water soaks into the walls and bottom of the ditch all along its length. Wet soil along the ditch readily grows vegetation which further uses additional water through transpiration. Vegetation growing under the water surface further retards the flow of water through the ditch, exposing the water to further losses through evaporation. Water lost during transporting from source to the use location is wasted. In arid locations such waste may be of great importance due to the lack of sufficient water at the source to make up for the loss in transporting.

SUMMARY OF THE INVENTION

An economical method of producing a durable structure for directing or holding water is described. The method produces a reinforced elastomeric silicone membrane, impervious to liquid water, lining the surface of a depression suitable to direct, transport, or hold water. The method first lays cloth upon a surface convenient to the depression, then coats the cloth with a liquid silicone elastomeric composition curable at atmospheric conditions. The cured elastomeric composition has a modulus which provides sufficient flexibility to the coated cloth so that the coated cloth will assume the contours of the depression when the cured coated cloth is placed into the depression. The coated cloth is allowed to cure after coating, when moved to the depression and placed into the depression. When it is necessary to use more than one piece of cloth, the adjoining edges of the coated cloth are bonded together at the seams. The edges of the coated cloth at the perimeter of the depression are then stabilized to hold the cloth in place. The seams are preferably bonded together by applying a liquid silicone elastomeric composition that is curable at atmospheric conditions. The liquid elastomeric composition used to coat the cloth and to bond the seams is preferably an aqueous silicone emulsion.

It is an object of this invention to provide a method of constructing a water harvesting structure or component that is particularly adapted for use in locations where the structure is difficult to get to, such as in mountainous terrain.

It is an object of this invention to provide a method of constructing a water harvesting structure or its components that is economical to manufacture, yet has a long service life, by producing a cloth reinforced silicone elastomeric membrane, then moving the membrane to cover a depression suitable to direct, transport, or hold water. Bonding the seams and stabilizing the edges of the membrane yields a durable structure lined with a liquid water impervious membrane.

BRIEF DESCRIPTION OF THE DRAWINGS

Referring to the drawings.

Figure 1:
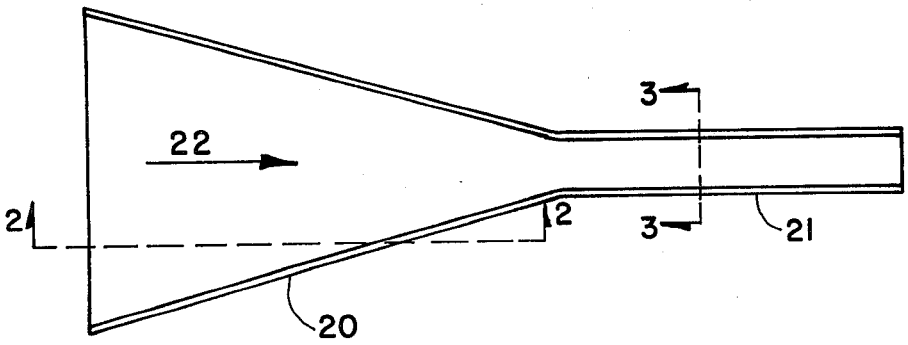
FIG. 1 is a plan view of a catchment 20 and transporting duct 21.

FIG'S. 6, 7, 8, and 9 are various means of providing seams.

FIG'S. 10, 11, 12, and 13 are various means of stabilizing edges of the coated cloth membrane.

DESCRIPTION OF THE INVENTION

This invention relates to a method of constructing a means suitable for directing, transporting, or holding water comprising (A) laying cloth upon a surface, said surface being convenient to a depression suitable to direct, transport, or hold water, then; (B) coating the cloth with a liquid silicone elastomeric composition curable at atmospheric conditions to an elastomer having a modulus which provides sufficient flexibility to the coated cloth so that the coated cloth will assume the contour of the depression; (C) allowing the coated cloth to cure, the coated cloth being impervious to liquid water; (D) moving the cured, coated cloth to the depression, then; (E) placing the coated cloth into the depression where the coated cloth assumes the contour of the depression, then; (F) bonding the coated cloth at seams, and (G) stabilizing the coated cloth at unseamed edges to yield a means suitable for directing, transporting, or holding water having a covering impervious to liquid water.

The method of this invention is particularly adapted to those locations where it is difficult to obtain access to the depression to be lined. When the depression suitable to direct, transport, or hold water is readily accessible, it is preferable to form a coated cloth lining in place in the depression as taught in U.S. Patent Application titled, "Method of Directing or Holding Water," by Brady, Elias, Gavin, and Meddaugh, filed on the same date as the instant application. That method coats the cloth after it is in place, thus allowing the depression to be covered with uncoated cloth which easily follows the contour of the depression since cloth itself normally drapes easily. In some locations, such as mountainous slopes without road access, it would be very difficult to transport the rolls of cloth, drums of liquid silicone elastomeric composition, and equipment for applying the composition to the cloth, to the site of the depression. In such cases, a more suitable method is that taught herein.

A location is selected for coating the cloth that is both convenient to the site of the depression and can be easily supplied with the materials to be used. In mountainous terrain, for instance, such a location could be a meadow or road at the base of the slope on which the depression is located. The cloth can be more easily coated and a higher quality coating can be obtained if the location for coating the cloth is flat, fairly smooth, and easily accessible. When a large amount of silicone elastomeric composition is used, such as drum quantities, it is easier to transport the coated cloth over difficult terrain then to transport drums of liquid. For one thing, the coated cloth does not contain the water or solvent present in the composition before curing, thus the coated cloth weighs less than the beginning components.

An efficient method of coating the cloth would be to lay out the cloth upon a flat surface in a relatively large area and coat it by spraying, using a power spray system. Such systems are commonly powered by a large compressor driven by a gasoline or diesel motor, the combination being mounted on wheels. It is easier to obtain a uniform coating with a minimum number of flaws when the coating is done in such a convenient location rather than at the site of a depression having difficult access. The depression may be upon a hillside which is covered by trees and brush, which makes moving about with equipment difficult. The site of the depression may be an exposed hillside subjected to frequent and strong winds which makes uniform coating more difficult. After the cloth is coated and cured, it can be cut into convenient pieces, folded or rolled up and moved to the site of the depression to be covered.

The means for directing or holding water comprises a depression lined with a coated cloth that follows the contour of the depression. The coated cloth, which can consist of many pieces, is fastened together at adjoining edges to make seams by adhesive bonding. The unseamed edges at the perimeter of the cloth are stabilized to prevent movement of the coated cloth. The coated cloth is produced by first laying cloth upon a surface convenient to the depression to be lined. The cloth is then coated with a liquid silicone elastomeric composition curable at atmospheric conditions. The cured elastomeric composition has a modulus which provides sufficent flexibility to the coated cloth so that the coated cloth will assume the contour of the depression when the coated cloth is placed into the depression.

The method of this invention concerns means for economically collecting, transporting, and holding water by moving water by means of gravity flow over or through lined depressions, such as catchments, transporting ducts, and holding ponds. The method is adaptable to construction using ordinary tools and unskilled labor so that the method is economical. The method is adaptable to both large and small constructions in areas that are easily accessable or in remote locations that are difficult to reach, such as isolated mountainous regions.

To further explain the invention, a construction comprising a catchment 20 and transporting duct 21 will be discussed as illustrated in FIG. 1 as examples of a depression suitable to direct and transport water. The direction of water flow is shown as 22.

The size of the catchment 20 is determined by the area of suitable land available, as well as the area necessary in order to collect the required amount of water. The more water required, the larger the area required. The lower the amount of expected precipitation, the larger the area required. The area should have a gradual slope so that the water flows down the catchment area and through the transporting duct to the predetermined destination. The predetermined destination can be a storage tank or pond to store the water, or it can be an irrigation system to distribute the water to crops.

Figure 2:
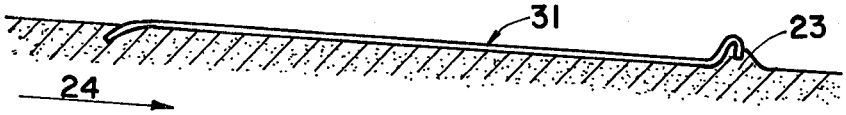
FIG. 2 is a cross section of the catchment along line 2—2 in FIG. 1.

FIG. 2 is a cross section of the catchment 20 along the line 2—2 in FIG. 1. The direction of slope is shown by 24. A dike 23 is built up of earth to aid in directing the water flow to the transporting duct. The dike is built up to a height sufficient to contain the maximum amount of water expected to be present at any one time. In snowfall areas, the dike will also tend to trap snow which could otherwise blow away before melting. The coated cloth 31 is present, in areas of porous soil, to prevent the water collected by the catchment from soaking into the earth, rather than flowing down to and through the transporting duct. The coated cloth also aids in preventing the destruction of the catchment and transporting duct due to long term weathering and due to the effects of plants growing in the area.

In an area that consists primarily of impervious soil or rock, the suitable catchment can consist essentially of a dike or dikes arranged at the lower end of the catchment area to direct water flowing down over the surface of the catchment area to the transporting duct.

The upper edge of the coated cloth is shown buried in the soil to stabilize it. Water flowing down the slope flows over the buried cloth edge onto the coated cloth surface and is directed by the dikes into the transporting duct. The coated cloth lining the catchment area, dikes, and transporting duct prevents loss of water by soaking into the ground and also prevents erosion of the catchment and transporting duct due to the flowing water.

Figure 3:
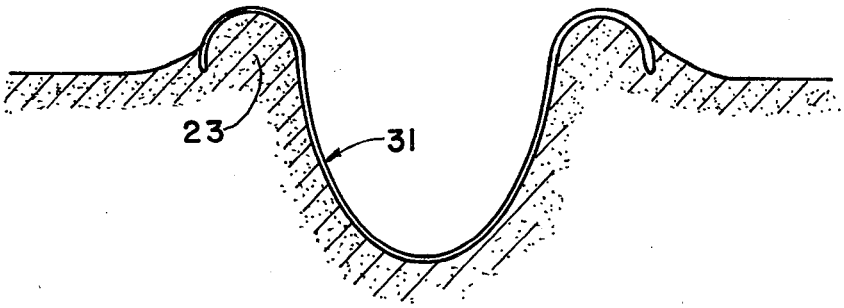
FIG. 3 is a cross section of the transporting duct along line 3—3 in FIG. 1.

FIG. 3 is a cross section of a transporting duct along the line 3—3 in FIG. 1. The duct is constructed of such a size that it is capable of containing the flow of water from the catchment or other source. The dike 23 on the edge of the duct prevents surface water from flowing under the coated cloth 31 which lines the surface of the duct. The coated cloth is used here for the same purposes as in the catchment.

The depression used in the method of this invention must be shaped to direct or contain the water as desired. A depression intended to transport water must, of course, slope in the direction of desired water flow. The amount of slope is chosen to assure water flow without excessive speed. It is desirable to clear the area of all vegetation and smooth the surface left by clearing to as great an extent as practical. A smooth surface such as that left by raked sand or soil makes possible a smooth coated cloth that maximizes water flow and minimizes hold up of water. A smooth surface under the coated cloth also makes it easier to lay out the coated cloth and fasten pieces together at seams.

If the earth surface of the depression is such that the growth of plants or seeds in the surface is likely, it is desirable to treat the surface with a herbicide to prevent possible growth under the coated cloth after it is in place.

The depression to be covered can be either a newly constructed structure such as a catchment, transporting duct, irrigation ditch, holding pond, lake, terrace, or such structure, or it can be a previously formed structure. A depression, for instance, could be an irrigation ditch that is in use without a lining or one in which the lining has deteriorated, for instance a concrete lined irrigation ditch that has cracked or spalled to the point where water is lost. An unlined irrigation ditch wastes a significant amount of water in that the quantity of water delivered at the end of the ditch can be as little as 50 percent of that entering the ditch. The earth surface, whether newly prepared or not, should be smoothed and prepared as discussed above. The surface to be covered by the coated cloth is such that the final covering is not damaged from contact with the surface.

If the surface of the containment area is impervious soil or rock, it is not necessary to completely cover the area with a smooth layer of fine sand or soil as discussed above. The surface of the area would not need to be completely covered with the coated cloth membrane since the surface would already be suitable for collecting water. The only preparation that would be necessary would be the construction of the dikes at the lower end of the catchment area to direct the water to the transporting duct.

The cloth used in the method of this invention can be either woven or nonwoven of many fibers that are preferably resistant to decomposition in contact with the earth such as glass, polypropylene, polyester, nylon, rayon or acrylic, or blends of these fibers. The thickness of the cloth can be varied depending upon the strength and durability desired for the application. Generally, the thicker the cloth, the stronger it will be and the longer it will be able to function properly. Practical cloth thicknesses for nonwoven fabrics have varied from as little as 0.2 mm to as high as 1.2 mm. Cloth is usually obtained in the form of rolls.

The cloth is unrolled upon a surface convenient to the depression that is going to be lined. The surface should be flat, reasonably smooth and clean so that the cloth can be unrolled and rolled up after coating, with a minimum of effort or damage. Suitable surfaces would be flat, open fields, gravel roads, paved roads, parking lots, or buildings with large, open floor areas. The method and materials used to coat the cloth help direct one to the most suitable location for the coating step. If the cloth is to be coated by spraying, for instance, it is desirable to select a location for the coating step that is accessible to a compressor for the sprayer. If a large area is to be covered, necessitating a supply of liquid silicone elastomeric composition measured in the multi-drum amount, the location should allow delivery of such containers. Since the preferred liquid silicone elastomeric composition is an aqueous emulsion, when this composition is used, a location where water is available for clean-up is desirable. Of course, the location should be convenient to the depression to be covered as the coated cloth will have to be moved to the depression to complete the process.

After the cloth is unrolled upon the surface convenient to the depression to be lined, the cloth is coated with a liquid silicone elastomeric composition. It is necessary that the liquid silicone elastomeric composition cure at atmospheric conditions when it is applied to the cloth. Atmospheric conditions are those conditions of temperature and humidity present at the time of coating the cloth. The viscosity of the liquid silicone composition is chosen or adjusted so that the composition interfuses the cloth surface and seals the spaces between the fibers to yield a surface impervious to liquid water. The composition should soak into the cloth so that the cured coating is firmly bonded to the cloth. The composition should not soak completely through the cloth in sufficient quantity to cause bonding to the underlying surface, since the cured cloth must be moved as the next step of this method. The amount of penetration by the liquid silicone elastomeric composition into the cloth during the coating step is a function of the composition viscosity, the amount of composition applied, and the thickness and weave of the cloth being coated. The coated cloth, 31 in FIG. 6 for instance, is required to be coated with sufficient composition to yield a surface impervious to liquid water. The liquid silicone elastomeric composition can be a solvent dispersion or an aqueous emulsion. The composition is applied to the cloth by any suitable method such as brushing, rolling, or spraying. A preferred method is spraying with an airless spray system where such equipment is available. It is easier to obtain uniform coating of the cloth by spraying. Where spray equipment is not available, the coating can be by methods such as rolling or brushing, being careful to obtain as uniform a coating as possible without damaging the cloth during the coating process. An advantage of the method of this invention is the fact that the method can be carried out without the use of power equipment, if this is necessary.

It is desirable to apply the coating to the cloth in at least two coats, the second application being at right angles to the first. Such a procedure yields a more uniform coating with less chance of pin holes. The cloth can be coated on one or both sides.

Each application of liquid silicone elastomeric composition to the cloth is allowed to cure by allowing it to remain undisturbed while exposed to atmospheric conditions. If a solvent dispersion is being used, the vapors should be properly avoided by the personnel doing the work. An aqueous emulsion form of silicone elastomeric composition is desirable due to the lack of hazardous vapor during cure and ease of clean-up of equipment and personnel.

An elastomeric silicone emulsion useful in this invention comprises (a) 100 parts by weight of an anionically stabilized, hydroxyl endblocked polydiorganosiloxane, present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said silicone emulsion having a pH of 9 to 11.5. Such elastomeric silicone emulsions are commercially available.

Silicone elastomeric compositions such as these are disclosed in U.S. Pat. No. 4,221,688, issued Sept. 9, 1980, to Johnson, Saam, and Schmidt, which is hereby incorporated by reference to describe silicone elastomeric compositions in the form of aqueous emulsions which are useful in the present invention for coating on the cloth and as bonding agents for use in bonding the seams. Such silicone elastomeric compositions cure by removal of the water from the emulsion.

There are also available liquid silicone elastomeric compositions based upon solvent dispersions of silicone compositions that cure at room temperature upon exposure to the atmosphere. Such systems that cure upon exposure to the moisture in the air are described in U.S. Pat. No. 3,189,576, issued June 15, 1965 to Sweet and U.S. Pat. No. 3,334,067, issued Aug. 1, 1967 to Weyenberg, both of which are hereby incorporated by reference to show the manufacture of silicone elastomeric compositions that cure at atmospheric conditions and which may be liquid in the form of solvent dispersions suitable for coating on cloth and as bonding agents as used in this invention.

The liquid elastomeric compositions preferred for use in this invention are the aqueous emulsions, due to their low toxicity, ease of use, and ease of clean-up.

Examples of combinations of cloth and elastomeric silicone emulsions that have been used successfully are herein described. An elastomeric silicone emulsion having a solids content of 40 percent by weight and a viscosity of 25 Pa.s at 23° C. was sprayed onto a nonwoven polypropylene cloth of about 1.0 mm thickness. The emulsion penetrated into the fabric and sealed it to give an impervious coating. The solids content is the percent of nonvolatile material remaining in a 2 gram sample of the emulsion that has been heated for 1 hour at 150° C. in an air circulating oven. The sample is in an aluminum foil dish, 60 mm in diameter and 15 mm deep. An emulsion with a solids content of 67 percent by weight and a viscosity of 60 Pa.s at 23° C. has also been found suitable for use with this fabric. The thicker, higher solids emulsion does not penetrate into the fabric as far as does the thinner material. A spun bonded, nonwoven polyester fabric having a thickness of 0.2 mm works well with the 40% solids, 25 Pa.s viscosity emulsion disclosed above. The emulsion is liquid enough to flow down into the fabric, resulting in the cloth being impregnated by the emulsion. The emulsion cannot be allowed to flow completely through the fabric to the surface underneath as this would allow the cloth to become adhered to the surface. If desired, the cloth can be coated with a first coat that penetrates into the cloth, then subsequent coats would be applied to seal the cloth, resulting in an impervious coating on the cloth. The minimum solids content of the emulsion is about 25 percent by weight based on the total weight of the emulsion. A preferred formulation that has functioned well is shown in the Example.

The hydroxyl endblocked polydiorganosiloxanes useful in the aqueous emulsions used in this invention are those which can be emulsified and which will impart elastomeric properties to the product obtained after the removal of water. The best physical properties are obtained when the weight average molecular weight of the polymer is above 50,000. The preferred molecular weights are in the range of 200,000 to 700,000. The most preferred hydroxylated polydiorganosiloxanes are those prepared by the method of anionic emulsion polymerization described by Findley et al. in U.S. Pat. No. 3,294,725, issued Dec. 27, 1966, which is hereby incorporated by reference to show the methods of polymerization and to show the hydroxyl endblocked polydiorganosiloxane in emulsion. The anionic surfactants used are preferably the salt of the surface active sulfonic acids used in the emulsion polymerization to form the hydroxyl endblocked polydiorganosiloxanes as shown in U.S. Pat. No. 3,294,725 cited above which is hereby incorporated by reference to show the surface active sulfonic acids and salts thereof.

Colloidal silica is a required ingredient in the preferred emulsion. The silicone emulsion does not yield a cured film upon drying if the colloidal silica is not present in the composition. Any of the finely divided colloidal silicas that are capable of being dispersed in the silicone emulsion can be used. A preferred form of colloidal silica is available as colloidal silica dispersions in water. A preferred amount of colloidal silica from 15 to 50 parts by weight based upon 100 parts by weight of polydiorganosiloxane. As the amount of silica is increased, the modulus of the cured elastomer increases. Since the coated cloth must be flexible enough to assume the contour of the depression, the maximum amount of silica that can be used is controlled by this flexibility requirement.

An alkyl tin salt, preferably a dialkyltindicarboxylate, is used to reduce the storage time between the preparation of the silicone emulsion and the time an elastomeric product can be obtained from the silicone emulsion by removal of the water under ambient conditions to an acceptable range of one to three days. Dialkyl tin salts can be used in amounts of from 0.1 to 2.0 parts by weight for each 100 parts by weight of the hydroxyl endblocked polydiorganosiloxane, preferably about 0.1 to 1.0 parts by weight. Dialkyltincarboxylates which are preferred include dibutyltindiacetate, dibutyltindilaurate, and dioctyltindilaurate.

Another useful ingredient for addition to the silicone emulsion is a filler other than colloidal silica. Such fillers can be added to provide pigmentation which can be used, for example, as a colorant or as an ultraviolet light screening agent. Other fillers can be used as extending fillers which can be used to reduce the cost per unit of the elastomeric product. The use of filler other than colloidal silica can also have an effect upon the modulus of the cured elastomer. As the amount of filler is increased, the modulus of the cured elastomer is increased. Since these fillers do not ordinarily act as reinforcing fillers, much larger quantities can be added before the modulus is effected to a significant degree. Examples of fillers other than colloidal silica include carbon blacks, titanium dioxide, clays, aluminum oxide, quartz, calcium carbonate, zinc oxide, mica, and various colorant pigments.

The preferred method of preparing the elastomeric silicone emulsion is to emulsify a hydroxyl endblocked polydiorganosiloxane using an anionic surfactant, add the colloidal silica, and then adjust the pH within the range of 10.5 to 11.5 inclusive. The preferred method of adjusting the pH has been found to be with a basic compound such as an organic amine, an alkali metal hydroxide, or a combination thereof. The preferred organic amine is diethylamine. The preferred alkali metal hydroxide is sodium hydroxide. After adjustment of the pH, the alkyl tin salt is added.

Further particulars on the preferred elastomeric emulsion used in the method of this invention are found in U.S. Pat. No. 4,221,688, issued Sept. 9, 1980, to Johnson, Saam, and Schmidt which is hereby incorporated by reference to further show the methods of manufacture.

After the coated cloth is prepared as discussed above, it is moved to the depression which has been prepared as discussed above. Since the coated cloth is prepared from a composition which cures to give an elastomer having a modulus which provides sufficient flexibility to the coated cloth which will assume the contour of the depression, the coated cloth can be easily folded or rolled into parcels that are then moved to the depression.

The coated cloth can be a single piece or it can be many pieces depending upon the area of the depression to be covered, the terrain between the site of the coating step and the site of the depression, and the means being used to move the coated cloth. Suitable means for moving the parcels, such as by hand, horse, or truck, depends upon the distance between the location where the cloth is coated and the depression to be lined, and upon the nature of the intervening terrain.

After moving, the coated cloth is unfolded or unrolled and placed into the depression to cover the surface of the depression. Because of the flexibility of the coated cloth, it assumes the contour of the depression as it is placed into the depression.

The flexibility of the coated cloth can be varied to best fit the depression being covered. If the depression is a large area with no sharp corners or abrupt changes of contour, the coated cloth does not need to be as flexible as would be required for an area having such changes of contour. For instance, if an irrigation ditch or acequia is about 30 cm wide and 30 cm deep, the coated cloth would have to be quite flexible so that it would drape down into the ditch under its own weight and fit tightly against the underlying surface. In a large ditch of 3 or 4 meters width and 1 or 2 meters depth with gently sloping sides, a stiffer coated cloth could be used as it would easily assume the contour of the depression. The flexibility of the coated cloth depends upon the thickness and weave of the cloth as well as the modulus of the elastomer used. The lower the modulus of the cured elastomer, the more flexible the coated cloth will be. The thinner the cloth and the thinner the elastomeric coating, the more flexible the coated cloth will be.

The coated cloth is normally placed into the depression with the coated side of the cloth up, where only one side of the cloth is coated. The silicone elastomeric coating protects the cloth from any weathering effects, as well as presents a smooth surface that encourages maximum rate of water flow.

Because the area to be lined is ordinarily larger than a single piece of coated cloth, the covering is generally made up of a series of strips of the coated cloth, the strips being joined together at a seam. Several methods of joining the coated cloth strips at the seams are useful in the method of this invention.

Figure 6:
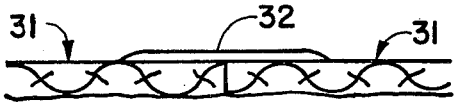

One method of forming a seam is illustrated in FIG. 6. The strips of coated cloth 31 are layed out upon the prepared surface so that their edges meet. The joint produced is then made impervious to liquid water by coating the joint with a silicone elastomeric composition 32 which is curable under atmospheric conditions. Any silicone elastomeric composition which is of a low enough viscosity to allow application to the joint, cures at atmospheric conditions, and bonds to the coated cloth is useful in this method. One type of useful silicone elastomeric composition is the caulk materials which are commercially available that are packaged in tubes for storage. They are extruded onto the joint and tooled to form a tight seal, then allowed to cure under atmospheric conditions. Another type of composition which may be used are the liquid silicone elastomeric compositions described above. The preferred silicone elastomeric composition is the silicone emulsion described above as preferred for coating the cloth. The joint is formed as shown in FIG. 6, then the emulsion is applied over the joint by spraying, brushing, or rolling and allowed to dry. One or more coats can be applied to yield a sealed joint impervious to liquid water.

Figure 7:
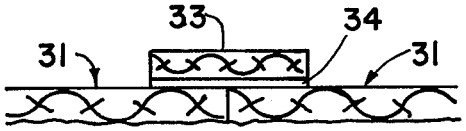

Another method of forming a seam is illustrated in FIG. 7. The strips of coated cloth 31 are layed out upon the prepared surface so that their edges meet. A strip of coated cloth 33 is then bonded over the joint using an adhesive 34. The adhesive 34 can be any silicone elastomeric composition that bonds to the membrane and cures under atmospheric conditions. The preferred silicone elastomeric composition is the emulsion as discussed above.

Figure 8:
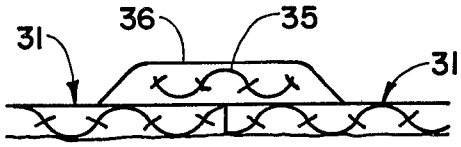

Another method of forming a seam is illustrated in FIG. 8. The strips of coated cloth 31 are layed out upon the prepared surface so that their edges meet. A strip of uncoated cloth 35 is then applied over the seam and the uncoated cloth 35 is impregnated with a liquid silicone elastomeric composition 36 to bond the impregnated cloth to the underlying pieces of coated cloth. The uncoated cloth can be impregnated by first coating the coated cloth in the joint area with a layer of liquid silicone elastomeric composition. If the uncoated cloth used is thin enough or porous enough, the dry cloth can be applied over the joint, then enough liquid silicone elastomeric composition applied over the cloth to impregnate it and bond it to the underlying membrane. Any liquid silicone elastomeric composition can be used as long as it is fluid enough to impregnate the uncoated cloth, bonds to the membrane, and cures under atmospheric conditions. A preferred liquid silicone elastomeric composition is the emulsion discussed above.

Figure 9:
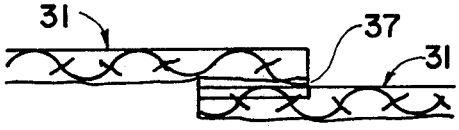

Another method of forming a seam is illustrated in FIG. 9. The strips of coated cloth 31 are layed out upon the prepared surface so that they overlap for a distance, for instance about 150 mm, then the overlapping area is sealed by applying an adhesive 37 between the layers of coated cloth 31. The adhesive can be any silicone elastomeric composition that bonds to the coated cloth and cures under atmospheric conditions. The preferred silicone elastomeric composition is the emulsion as discussed above.

In order for the coated cloth that lines the catchment area and duct to function properly, the coated cloth must be secured to the underlying terrain, at least at the unsealed edges at the outer perimeter. Several suitable means are useful, depending somewhat upon the nature of the surface of the catchment area and duct. For example, if the catchment area is composed of compacted impervious soil or rock, the edge of the coated cloth may be bonded to the underlying surface with a suitable adhesive. The preferred adhesive is a silicone elastomeric composition such as those described above for bonding the coated cloth together at the seams. The purpose of bonding the coated cloth to the surface is to prevent water from running under the coated cloth and causing the coated cloth to move about relative to the surface it is laying on. Where it is necessary to construct a dike, the dike would ordinarily be constructed of soil or earth, at least on the outer surface. Since such a construction is not impervious to water, it is necessary to use other methods of bonding the coated cloth to the surface.

Figure 10:
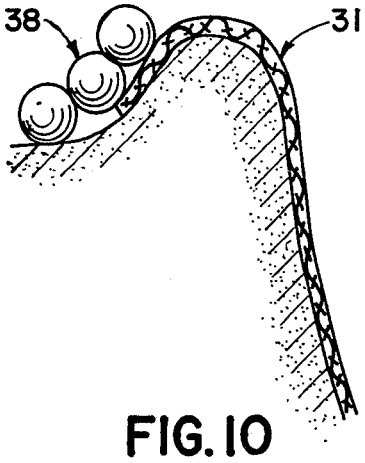
Figure 11:
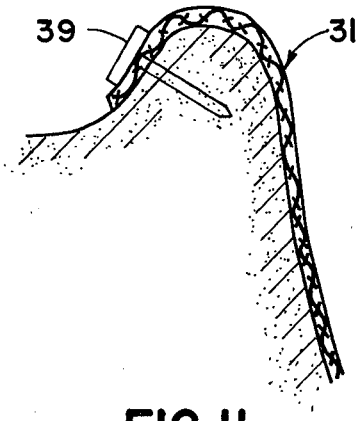
Figure 12:
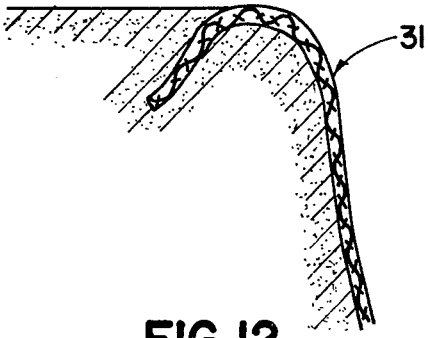
Figure 13:
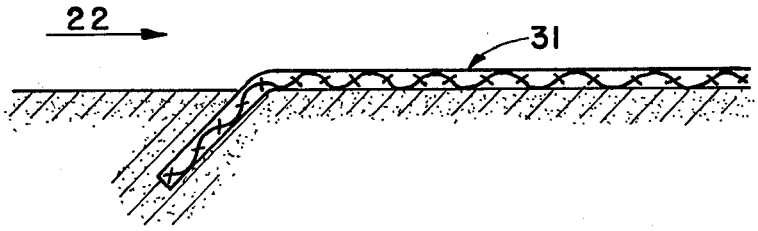

The simplest method of stabilizing the coated cloth at the unseamed edge to a dike 23 is illustrated in FIG. 3. The coated cloth 31 is layed over the dike so that the edge of the coated cloth is located on the back side of the dike. The edge of the coated cloth is then buried under soil placed on the back side of the dike. FIG. 10 illustrates the edge of the coated cloth 31 ballasted with rocks or logs 38 to secure the membrane. FIG. 11 illustrates the coated cloth 31 secured to the back side of a dike by means of a peg with a large upper head 39. Other mechanical fasteners such as a staple-shaped rod are also suitable. FIG. 12 illustrates the stabilizing of the cloth edge by burying the coated cloth 31 in a small side ditch next to the main transporting duct. FIG. 13 illustrates a method of stabilizing the coated cloth edge where it is exposed to water flow, as at the upper edge of a catchment that is constructed to gather water flowing down a hillside as shown in FIG. 1. The upper edge of coated cloth 31 used to line an irrigation ditch could be buried in such a manner to stabilize the cloth. The water flowing into the irrigation ditch would be prevented from getting underneath the cloth and displacing it. The water flow direction is shown by 22.

The method of this invention yields a means suitable for directing or holding water. The means is unique because of the nature of the coated cloth. The coated cloth can be easily produced. When the preferred elastomeric silicone emulsion is used to prepare the coated cloth, no dangerous or hazardous substances are given off during the coating and drying steps. The coated cloth is easily rolled up and transported to the site of the depression to be lined. The coated cloth is flexible and elastic at installation temperatures ranging from below −30° C. to above 70° C. so that the coated cloth can be installed both in winter and in summer. The coated cloth is particularly useful in this method because it is resistant to the effects of hot and cold temperatures, sunlight, oxidation from the air, and other causes of outdoor weathering. The installation of the coated cloth according to the method of this invention can be accomplished without highly skilled and expensive labor.

Many previous methods used to form water harvesting areas are more complicated to construct and more expensive. Methods such as lining with concrete, both with and without metal reinforcement, are expensive due to the cost of the concrete and reinforcement and the amount of labor and equipment necessary to put the concrete into place and hold it there until it cures. Such a lining is subject to cracking from temperature changes since it has no elasticity. Much the same is true of asphalt, but in addition, heavy equipment is required to heat the asphalt and to spread it and compact it in place. Asphalt is subject to cracking from temperature changes and to weathering from the sun and from the oxygen in the air. Methods using asphalt emulsion suffer due to the inability of the asphalt to withstand temperature changes and weathering effects in the relatively thin coatings used.

The method of making a means suitable for directing or holding water of this invention is particularly useful for agricultural areas that are difficult to get to. If necessary, the required shaping of the depression suitable to direct, transport, or hold water can be done with hand tools. The lining of the area with the coated cloth, sealing the seams, and stabilizing the edges of the coated cloth, can all be done without expensive, heavy equipment. The coated cloth is resistant to weathering so that the structure will have a long, useful life. A particular use is as a water harvesting structure for use for animals in mountainous terrain.

The following example is presented for purposes of illustrating the invention and should not be construed as limiting the scope of the invention which is properly delineated in the claims.

EXAMPLE

A catchment area was prepared by grading and smoothing an area in an Ponderosa Pine Forest at an elevation of 2400 meters. After the surface of the area was smoothed, it was treated with a herbicide to prevent further growth of vegetation in the area.

A storage pit was dug below the catchment to contain the water collected by the catchment. A pipe connected the lower edge of the containment to the storage pit.

Figure 4:
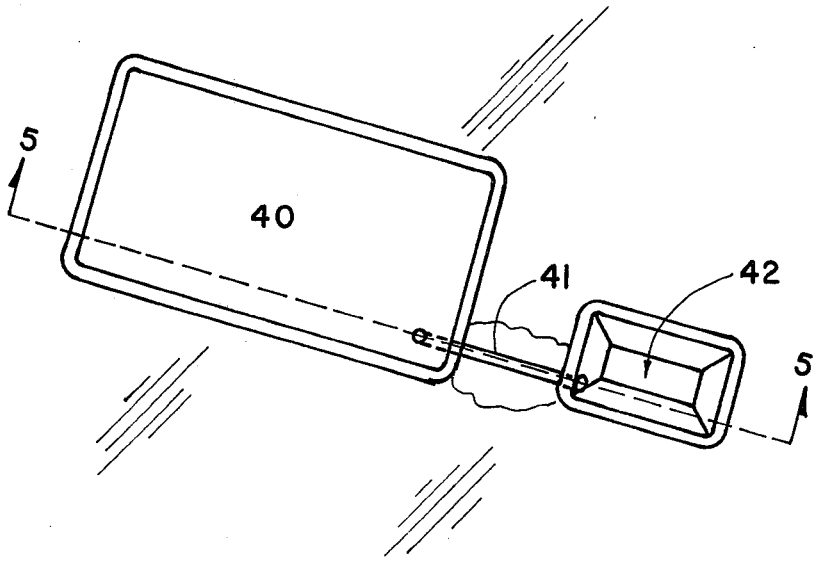
FIG. 4 is a plan view of a catchment 40 and storage pit 42.
Figure 5:
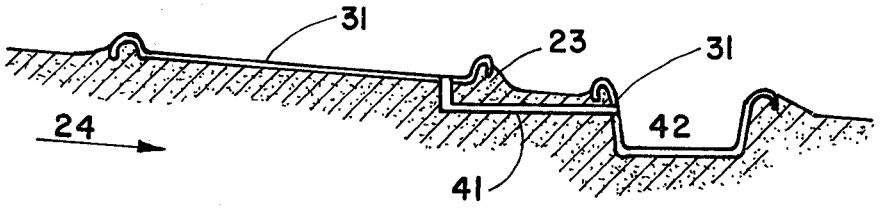
FIG. 5 is a cross section of the catchment and storage pit along line 5—5 in FIG. 4.

FIG. 4 is a top view of the catchment 40 connected by the pipe 41 to the storage pin 42. FIG. 5 is a cross section along line 5—5 in FIG. 4.

An anionically stabilized emulsion polymerized polydimethylsiloxane was prepared containing about 58 percent by weight of hydroxyl endblocked polydimethylsiloxane having a weight average molecular weight of about 325,000. This aqueous emulsion was anionically stabilized with the sodium salt of dodecylbenzenesulfonic acid present in an amount of about one percent based upon the weight of the emulsion.

A silicone elastomeric composition was prepared by first mixing 100 parts by weight of an aqueous sodium stabilized colloidal silica dispersion, having about 15 percent by weight silica, with 2 parts by weight diethylamine. Then 167 parts by weight of the above described emulsion of polydimethylsiloxane was added. Next, 0.3 part by weight of antifoam emulsion and 1 part by weight of a 50 percent by weight emulsion of dioctyltindilaurate were mixed in until uniform. Then 10 parts by weight of an acrylic thickening agent was mixed in until a uniform mixture resulted. The silicone emulsion had a viscosity of about 25 Pa.s at 23° C., a pH of about 11, and a solids content of about 40 percent by weight.

A coated cloth was prepared by laying out strips of a polyester nonwoven cloth about 1.1 mm thick on a paved parking lot. The cloth was sprayed with the above described silicone emulsion using an airless spray gun. The first coat was allowed to air-dry overnight, then the second coat was applied at right angles to the first. After the coating was dry, the strips were rolled up for transportation to the catchment area.

The edges of the prepared containment area were formed into dikes 23 in FIG. 5, about 0.3 meters high on the uphill side of the area and about 1 meter high at the downhill side of the area. The strips of coated cloth were unrolled over the containment area, placing the first strip over the downhill dike so that the edge of the coated cloth was at the lower edge of the outer surface of the dike.

The next strip of clotch was unrolled at the upper edge of the first strip, overlapping the edges about 150 mm to provide a seam area. The entire area of the containment was covered in this manner.

The overlapping seams were then sealed by coating both the contacting surfaces with a heavy coat of the same silicone elastomeric emulsion used to coat the cloth. The overlapping edges were then placed together and smoothed out to avoid wrinkling. The seams were then allowed to dry and cure. An additional coat of silicone emulsion was placed over the seams in those areas that did not appear to be fully coated and bonded.

The edges of the coated cloth 31 in FIG. 5 formed as above described were held down on the back sides of the dike by covering them with soil.

The storage pit 42 was covered with strips of the coated cloth 31 and the seams bonded in the same manner as was described above. The coated cloth was bonded to the ends of the pipe 41 between the catchment and storage pit using the same silicone elastomeric emulsion.

The catchment and storage pit has operated successfully in gathering rainfall and storing it for use in providing drinking water for animals. The installation has withstood both winter and summer conditions and is expected to have a long useful life.

That which is claimed is:

1. A method of constructing a means suitable for directing, transporting, or holding water comprising (A) laying cloth upon a surface, said surface being convenient to a depression suitable to direct, transport, or hold water, then (B) coating the cloth with a liquid silicone elastomeric composition curable at atmospheric conditions to an elastomer having a modulus which provides sufficient flexibility to the coated cloth so that the coated cloth will assume the contour of the depression, the amount of liquid silicone elastomeric composition being insufficient to cause bonding to the underlying surface, (C) allowing the coated cloth to cure, the cured cloth being impervious to liquid water, (D) moving the cured, coated cloth to the depression, then (E) placing the coated cloth into the depression where the coated cloth assumes the contour of the depression, then (F) bonding the coated cloth at seams, and (G) stabilizing the coated cloth at unseamed edges to yield a means suitable for directing, transporting, or holding water having a covering impervious to liquid water.

2. The method of claim 1 in which the depression in (A) to be covered is a catchment suitable for collecting water.

3. The method of claim 1 in which the depression in (A) to be covered is a transporting duct suitable for transporting water to a predetermined destination.

4. The method of claim 1 in which the depression (A) to be covered is a water holding area.

5. The method of claim 2 in which the depression in (A) comprises the catchment and a transporting duct serving as an outlet for the catchment.

6. The method of claim 5 in which the depression in (A) comprises the catchment, transporting duct, and a water holding area which serves as a reservoir for water from the transporting duct.

7. The method of claim 2 in which the depression in (A) comprises the catchment and a water holding area which serves as a reservoir for water from the catchment.

8. The method of claim 3 in which the depression in (A) comprises the transporting duct and a water holding area which serves as a reservoir for water from the transporting duct.

9. The method of claim 1 in which the liquid silicone elastomeric composition has a viscosity such that the composition interfuses the cloth surface but does not soak completely through the cloth.

10. The method of claim 9 in which the liquid silicone elastomeric composition comprises a hydrocarbon solvent dispersion of a silicone elastomeric composition.

11. The method of claim 9 in which the liquid silicone elastomeric composition comprises an aqueous silicone emulsion having a minimum solids content of about 25 percent by weight based on the total weight of the emulsion.

12. The method of claim 11 in which the aqueous silicone emulsion comprises (a) 100 parts by weight of an anionically stabilized, hydroxyl endblocked polydiorganosiloxane present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5.

13. The method of claim 12 in which the polydiorganosiloxane has an average molecular weight in the range of 200,000 to 700,000; the colloidal silica is present as a sodium stabilized colloidal silica dispersion in an amount of from 15 to 50 parts by weight; there is present a filler other than colloidal silica; the alkyl tin salt is a diorganotindicarboxylate; there is also present an organic amine composed of carbon, hydrogen, and nitrogen atoms, or carbon, hydrogen, nitrogen, and oxygen atoms, said organic amine being soluble in the amount of water present in the emulsion.

14. The method of claim 1 in which the cloth is a woven or nonwoven cloth comprising weather resistant fibers selected from the group consisting of glass, polyester, polypropylene, nylon, rayon, or acrylate, or a mixture of these fibers.

15. The method of claim 14 in which the fibers are polypropylene.

16. The method of claim 14 in which the fibers are polyester.

17. The method of claim 1 or 9 in which the cloth is coated by spraying.

18. The method of claim 1 in which the coated cloth comprises at least two pieces, the pieces being placed over the depression so that adjoining edges of the pieces form seams which are overlapping.

19. The method of claim 18 in which the overlapping seams are bonded with a liquid silicone elastomeric composition curable at atmospheric conditions.

20. The method of claim 19 in which the liquid silicone elastomeric composition is an aqueous silicone emulsion.

21. The method of claim 1 in which the coated cloth comprises at least two pieces, the pieces being placed over the depression so that seams formed by butting the edges of adjoining pieces of the coated cloth and applying at the seam area a silicone elastomeric composition.

22. The method of claim 21 in which the seam area is reinforced with an additional strip of coated cloth.

23. The method of claim 21 in which the seam area is reinforced by placing an additional strip of cloth over the seam, then impregnating the cloth with a liquid silicone elastomeric composition and allowing the composition to cure.

24. The method of claim 19, 21, or 22 in which the silicone elastomeric composition used to bond the seam is a caulking material.

25. The method of claim 19, 21, 22, or 23 in which the silicone elastomeric composition used to bond the seam is a solvent dispersion.

26. The method of claim 21, 22, or 23 in which the silicone elastomeric composition used to bond the seam is an aqueous silicone emulsion.

27. The method of claim 20, 21, 22, or 23 in which the silicone elastomeric composition is an aqueous silicone emulsion comprising (a) 100 parts by weight of an anionically stabilized, hydroxyl endblocked polydiorganosiloxane present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5.

28. The method of claim 27 in which the polydiorganosiloxane has an average molecular weight in the range of 200,000 to 700,000; the colloidal silica is present as sodium stabilized colloidal silica dispersion in an amount of from 15 to 50 parts by weight; there is present a filler other than colloidal silica; the alkyl tin salt is a diorganotindicarboxylate; there is also present an organic amine composed of carbon, hydrogen, and nitrogen atoms, or carbon, hydrogen, nitrogen, and oxygen atoms, said organic amine being soluble in the amount of water present in the emulsion, and the solids content of the emulsion is greater than 25 percent by weight based on the total weight of the emulsion.

29. The method of claim 1, 2, 3, 4, 5, 6, 7, or 8 in which the unseamed cloth edges are stabilized by bonding to the underlying earth surface, mechanical fastening, or burying beneath the earth surface.

30. The method of claim 2 in which the stabilizing comprises bonding to the underlying earth surface.

31. The method of claim 3 in which the stabilizing comprises burying beneath the earth surface.

32. The method of claim 6 in which the stabilizing comprises mechanical fastening.

33. The method of claim 1, 2, 3, 4, 5, 6, 7, or 8 in which the cloth of (A) is a nonwoven cloth; the coating of (B) is by means of spraying an aqueous silicone emulsion having a minimum solids content of about 25 percent by weight based on the total weight of the emulsion, comprising 100 parts by weight of an anionically stabilized, hydroxyl endblocked polydiorganosiloxane (a) present as an oil-in-water emulsion, from 1 to 150 parts by weight of colloidal silica (b), from 0 to 200 parts by weight of filler (c) other than colloidal silica, and from 0.1 to 2.0 parts by weight of alkyl tin salt (d), said emulsion having a pH of 9 to 11.5 and a viscosity such that the composition interfuses the cloth surface but does not soak completely through the cloth; the coated cloth is placed to cover the depression so that the adjoining edges are overlapped to form seams; the overlapping seams are bonded by applying at the seam area between the overlapping coated cloth, the aqueous silicone emulsion of (B) above, and the unseamed cloth edges are stabilized by burying them in the earth.

* * * * *